US007152657B2

(12) United States Patent
Bosma et al.

(10) Patent No.: US 7,152,657 B2
(45) Date of Patent: Dec. 26, 2006

(54) IN-SITU CASTING OF WELL EQUIPMENT

(75) Inventors: Martin Gerard Rene Bosma, Rijswijk (NL); Erik Kerst Cornelissen, Rijswijk (NL); Klisthenis Dimitriadis, Rijswijk (NL); Mike Peters, Rijswijk (NL); Robert Nicholas Worrall, Rijswijk (NL)

(73) Assignee: Shell Oil Company, Houston, TX (US)

( * ) Notice: Subject to any disclaimer, the term of this patent is extended or adjusted under 35 U.S.C. 154(b) by 319 days.

(21) Appl. No.: 10/479,728

(22) PCT Filed: Jun. 5, 2002

(86) PCT No.: PCT/EP02/06320

§ 371 (c)(1),
(2), (4) Date: Dec. 5, 2003

(87) PCT Pub. No.: WO02/099247

PCT Pub. Date: Dec. 12, 2002

(65) Prior Publication Data

US 2004/0149418 A1 Aug. 5, 2004

(30) Foreign Application Priority Data

Jun. 5, 2001 (EP) ..... 01202121

(51) Int. Cl.
*B22D 19/04* (2006.01)
*B22D 23/06* (2006.01)
*E21B 33/13* (2006.01)

(52) U.S. Cl. ..... 164/80; 164/98; 166/288; 166/292; 166/380

(58) Field of Classification Search ..... 164/80, 164/91, 98; 166/288, 292, 380, 207
See application file for complete search history.

(56) References Cited

U.S. PATENT DOCUMENTS

| | | | | |
|---|---|---|---|---|
| 2,298,129 | A * | 10/1942 | Irons | 166/288 |
| 3,578,084 | A * | 5/1971 | Bombardieri et al. | 166/288 |
| 4,489,784 | A * | 12/1984 | Messenger | 166/288 |
| 4,873,895 | A | 10/1989 | Taylor et al. | |
| 5,295,541 | A | 3/1994 | Ng et al. | |
| 6,431,282 | B1 * | 8/2002 | Bosma et al. | 166/288 |
| 6,474,414 | B1 * | 11/2002 | Gonzalez et al. | 166/277 |
| 6,923,263 | B1 * | 8/2005 | Eden et al. | 166/288 |

FOREIGN PATENT DOCUMENTS

| | | |
|---|---|---|
| FR | 2780751 | 1/2000 |
| SU | 1357540 A1 | 7/1985 |
| WO | 93/05268 | 3/1993 |

OTHER PUBLICATIONS

International Search Report dated Aug. 30, 2002.

* cited by examiner

*Primary Examiner*—Kevin P. Kerns

(57) ABSTRACT

A method is provided of in-situ casting well equipment wherein a metal is used which expands upon solidification. A body of such metal is placed in a cavity in a well. Before or after placing the metal in the cavity in the well, the body is brought at a temperature above the melting point of the metal. The metal of the body in the cavity is solidified by cooling it down to below the melting point of the metal.

36 Claims, 1 Drawing Sheet

IN-SITU CASTING OF WELL EQUIPMENT

FIELD OF THE INVENTION

The invention relates to a method for in-situ casting of well equipment.

BACKGROUND OF THE INVENTION

It is standard practice to cast cement linings around well casings to create a fluid tight seal between the well interior and surrounding formation.

A disadvantage of this and many other in-situ casting techniques is that the cement or other solidifying substance shrinks during solidification or curing as a result of higher atomic packing due to hydration and/or phase changes.

SUMMARY OF THE INVENTION

In accordance with one aspect of the invention, there is provided a method of in-situ casting well equipment wherein a metal is used which expands upon solidification, the method comprising the steps of:

- placing a body of said metal in a cavity in a well;
- bringing said body at a temperature above the melting point of the metal; and
- cooling down said body to below the melting point of the metal, thereby solidifying the metal of said body in the cavity.

In an embodiment, an expanding alloy is used, which expands upon solidification and which has a melting temperature that is higher than the maximum anticipated well temperature, which alloy is placed within a cavity in the well and held at a temperature above the melting point of the alloy, whereupon the alloy is cooled down to the ambient well temperature and thereby solidifies and expands within the cavity.

Preferably the expanding alloy comprises Bismuth. Alternatively the expanding alloy comprises Gallium or Antimony.

It is observed that it is known to use Bismuth compositions with a low melting point and which expand during cooling down from U.S. Pat. Nos. 5,137,283; 4,873,895; 4,487,432; 4,484,750; 3,765,486; 3,578,084; 3,333,635 and 3,273,641 all of which are hereby incorporated by reference.

However, in technologies known from these prior art references no well equipment made up of a Bismuth alloy is cast in-situ.

In various embodiment of the invention it is preferred that the alloy is lowered through the well within a container in which the temperature is maintained above the melting temperature of the alloy and an exit of the container is brought in fluid communication with the cavity whereupon the molten alloy is induced to flow through the exit from the container into the cavity.

In other embodiments, the alloy is placed in a solid state in or adjacent to the cavity and heated downhole to a temperature above the melting temperature of the alloy whereupon the heating is terminated and the alloy is permitted to solidify and expand within the cavity.

Optionally, the cavity is an annular cavity between a pair of co-axial well tubulars. Such cavity suitably has near a lower end thereof a bottom or flow restriction that inhibits leakage of molten alloy from the cavity into other parts of the wellbore.

Suitably, the annular cavity is formed by an annular space between overlapping sections of an outer well tubular and an expanded inner well tubular. The flow restriction can, for example, be formed by a flexible sealing ring located near a lower end of the annular space.

In such case it is preferred that a ring of an expanding alloy is positioned above a pre-expanded section of an expandable well tubular and around the outer surface of said tubular and that the ring of expanding alloy comprises an array of staggered non-tangential slots or openings which open up in response to radial expansion of the tubular. Alternatively the ring may be a split ring with overlapping ends. Upon or as a result of the heat generated by expansion of the tubular the ring will melt and solidify again and provide an annular seal.

To create a very strong seal in the annular cavity it is preferred that said body is a first body, the first body being axially restrained in the cavity by a second body of metal which expands upon solidification, and wherein the metal of the second body solidifies at a higher temperature than the metal of the first body, the method further comprising:

- placing the second body in the annular cavity axially displaced from the first body;
- melting said bodies by raising the temperature of said bodies;
- solidifying said bodies by lowering the temperature of said bodies, whereby the metal of the second body solidifies before the metal of the first body thereby axially restraining the first body.

Thus, the special expanding properties of Bismut, Gallium or Antimony and/or alloys thereof may be utilized to seal the cavities within well tubulars, the annuli between co-axial well tubulars, or the annulus between a well casing and the formation, or any small gap or orifice within the well or surrounding formation such as threads, leaks, pore openings, gravel packs, fractures or perforations.

BRIEF DESCRIPTION OF THE DRAWINGS

The invention will be described in more detail with reference to the accompanying drawings in which.

DETAILED DESCRIPTION OF THE DRAWINGS

Figure 1:
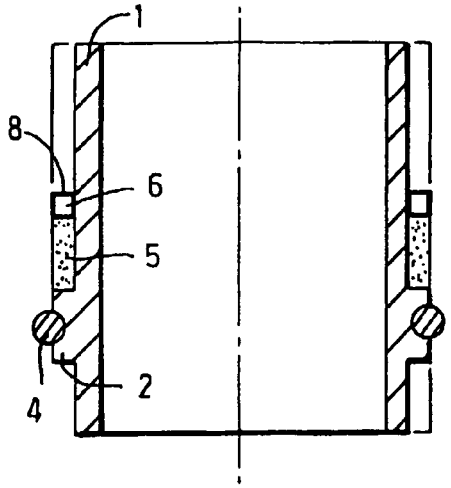
FIG. 1 shows a longitudinal sectional view of an expandable tubular around which two expandable alloy rings are arranged.
Figure 2:
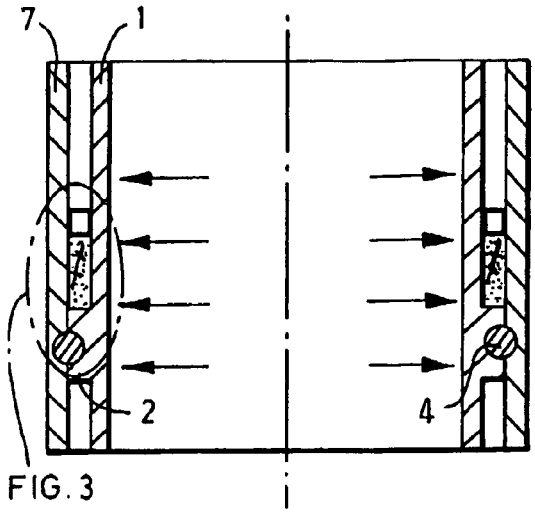
FIG. 2 shows the tubular and rings of FIG. 1 after expansion thereof within another tubular.
Figure 3:
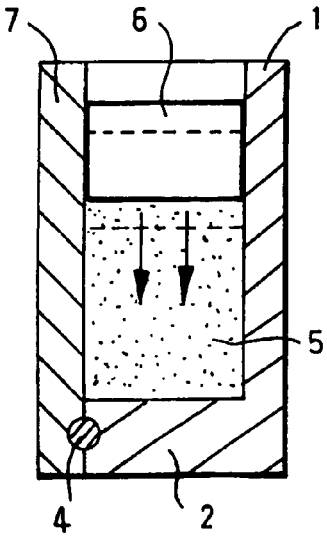
FIG. 3 shows in detail the annular space of FIG. 2 after melting of the alloy rings.

Referring to FIGS. 1 and 2 there is shown an expandable tubular 1, which is provided with a ring-shaped extemal shoulder 2. The shoulder 2 has a ring-shaped recess in which an O-ring 4 is arranged. Above the shoulder 2 a ring 5, made of an eutectic Bismuth alloy, is arranged.

The metal Bismuth, Atomic No. 83 and its alloys containing at least 55% by weight Bismuth expand whilst transiting from the molten into the solid phase.

Pure Bismuth (MP=271° C.) expands by 3.32 vol. % on solidification in ambient conditions, whilst its typical eutectic alloys such as e.g. $Bi_{60}Cd_{40}$ (MP=144° C.) typically expand by 1.5 vol. %.

The special expanding properties of Bismuth (and its alloys) may be utilized to seal the small annular space between an outer well tubular 7 and an inner expanded tubular 1 as shown in FIG. 2.

A ring 5 of Bismuth or Bismuth-alloy material is positioned on an upset shoulder 2 of a pre-expanded expandable tubular 1. The ring 5 may be continuous or slotted to permit expansion. The shoulder 2 can be perpendicular to the pipe axis, or tilted at an angle to permit sealing in a deviated well.

An additional upper ring 6 of Bismuth or Bismuth-alloy material with a melting point that is higher than ring 5 and with a density which is less than ring 5 is placed inside a flexible, temperature-resisting plastic or rubber bag (e.g. oven-safe plastic wrap) 8 and the combination of bag and ring 6 are placed on top of ring 5, such that the tubular 1, when vertical has from top to bottom: ring 6, ring 5 and then the upset shoulder 2. Rings 5 and 6 may also be continuous or slotted to permit expansion.

The Bismuth rings 5 and 6 and pre-expanded tubular 1 are run into the well in a normal manner. The casing is expanded using known pipe expansion techniques until the shoulder 2, O-ring 4 or additional seal sections are made to be in contact with the outer tubular 7. Additional seal sections may be included as part of the tubular, in the form of a lip or upset, or as an additional part, such as an elastomeric O-ring 4.

Once the tubular 1 is expanded so that the outer diameter of the expanded tubular 1 is in contact with the outer tubular 7, or any other external sealing mechanisms of the tubular 1 are in contact with the outer tubular 7, heat is applied. Heat is applied from the inside of the tubular 1 using a chemical source of heat, electric (resistive or inductive) heater, or through conductions of a hot liquid inside the tubular 1. This heat will increase the temperature of both Bismuth or Bismuth alloy rings until eventually both rings will melt and sag to the lowest point in the annulus by gravity.

The metal from ring 5 will take the lowest portion of the annular space, followed by the metal from ring 6, though the latter will remain contained by the plastic bag 8.

Figure 4:
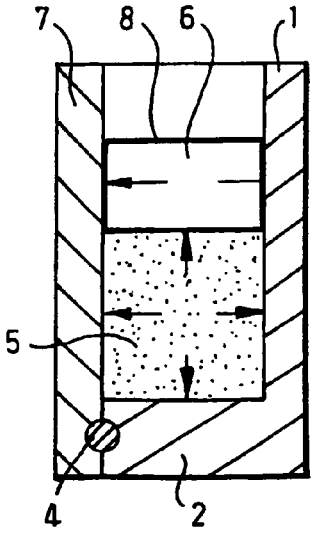
FIG. 4 illustrates how the upper expandable alloy ring expands upon solidification within the annulus and how subsequently the lower ring expands upon solidification.

The heat source will be removed, or heating will cease and the temperature in the wellbore will slowly lower to its original temperature. Ring 6 will be the first to freeze and will expand (mostly in the vertical direction), however, some outward force on the tubular 1 will help provide a frictional resistance to the expansion of ring 6. This may be aided by roughness or ledges being machined into either the outer or inner tubular 7 or 1 before running in hole. Ring 5 will solidify and expand following the solidification of ring 6, and being constrained will expand with a great sealing force in all directions, providing a tight metal-to-metal seal between the tubulars 1 and 7 as is illustrated in FIG. 4.

The Bismuth-alloy may be lowered into the well in a solid or liquid phase or may be created in-situ through an exothermic reaction.

The latter method may include the following steps. $Bi_2O_3$ and a highly reactive metal species, such as Al, are combined in a powdered form in a 1:1 ratio, such that they have a very high surface area per volume. This powder is deposited into the desired location via a coiled tubing or dump-bailer assembly. Subsequently, the powder (which could be pelletised or carefully sintered) is "ignited" by the discharge of a capacitor or other suitable electric or chemical method. The Al will react with the oxygen in the $Bi_2O_3$, forming nearly pure Bi, which will be molten due to the exothermic nature of this reaction and an $Al_2O_3$ low density solid slag will float (harmlessly) on the surface of the Bi pool.

Alternatively, if the Bismuth-alloy material is lowered in a solid phase into a well then the Bismuth-alloy material may form part of the completion or casing assembly (in the case of an annular sealing ring) or be positioned into the well through coiled tubing in the form of pellets or small pieces. In either case, surface cleaning of any pipe-sections to be sealed by the expanding Bismuth-alloy may be done through jetting or chemical means.

Subsequent to placement, heat is applied through for example electric resistive and/or induction heating, superheated steam injection, and/or an exothermic chemical reaction. The generated heat will melt the alloy, allowing a liquid column to form, whereupon the liquid column is allowed to cool down and the Bismuth-alloy will solidify and expand.

If the Bismuth-alloy is lowered in a substantially liquid phase into the well then the alloy may be melted on surface and carried to the desired downhole location via a double-walled insulated and/or electrically heated coiled tubing.

If certain low-melting point alloys are used, such as Bi—Hg alloys, it is possible to create additions (e.g. Cu) to these alloys which act as "hardeners". In this embodiment, liquid alloys with melting points lower than the well temperature are deposited in situ via coiled tubing. This could be achieved by gravity or with the aid of pressure facilitated through the action of a piston, or surface provider (pump). Subsequently, solid pellets of an alloying element can be added to the "pool"—if well selected, these can create a solid Bismuth-alloy.

A number of suitable downhole applications of expandable Bismuth-alloys is summarized below:

An expandable well abandonment plug: A liquid column of a suitable molten Bismuth-alloy may be created on top of a conventional mechanical or cement plug within a casing string. The melting point of the alloy used is selected greater than the equilibrium well temperature at that depth. Thus, the liquid Bismuth-alloy will solidify within the casing and the resultant expansion will lock the Bismuth-alloy plug-in place and form a gas-tight seal separating the lower section of the casing from that portion above.

An expandable annular seal plug: A liquid column of suitable Bismuth-alloy may be created on top of, or within the annular cement column between two casing strings, or liner and casing strings. An annular seal will be created in a manner similar to that described for the abandonment plug.

A temporary reversible plug—used, for example to temporarily shut off a multilateral well's lateral.

An external shut-off medium—A Bismuth-alloy may be injected into perforations, matrix rock, or fracture as a shut-off material. The alloy could create a kind of artificial casing material in one embodiment.

A repair medium—A Bismuth-alloy could be used to repair sand-screens, leaking packers, hanger seals, or tubing or casing within a well.

An alternate packer or liner hanger seal—Similarly to the annular seal plug, reversible packers or liner hanger seals may be created. In these cases, Bismuth-alloys could have their solidification expansion constrained by elastomer seals, or higher melting point (and thus solid sooner) Bismuth-alloys. These may be specifically applicable to the monobore well concept. Similar seals could be used for wellhead seals.

A more detailed description of a number of suitable Bismuth, Gallium or other expandable alloys will be provided below.

A wide selection of the expandable Bismuth, Gallium alloys may be used for each of the downhole applications described above. In addition to pure Bismuth the following binary alloys as detailed in paragraphs a)–f) below are considered to be the most likely building blocks from which ternary, quaternary and higher order alloys could be derived.

a) $Bi_{100-x}Sn_x$: where x=0 to 5. This will produce a solid solution alloy with a melting point >141° C. Small amounts of additional elements, such as Sb, In, Ga, Ag, Cu and Pb are possible. This alloy possesses the ability to be strengthened by a post-solidification precipitation hardening where an Sn-rich phase will be precipitated within the Bi-rich matrix. This alloy will present the largest expansion on solidification. Industrial examples of these alloys include: pure Bismuth, (sold as Ostalloy 520); $Bi_{95}Sn_5$, (sold as Cerrocast 9500-1 or Ostalloy 524564).

b) $Bi_{100-x}Cu_x$: where x=0 to 45. These alloys are considered for high temperature applications, such as in geothermal wells. The melting point of these alloys ranges from 271 to about 900° C.

c) $Bi_{100-x}Hg_x$: where x=0 to 45. These alloys are considered for lower temperature applications. The melting point of these alloys ranges from 150 to 271° C. These alloys will be less desirable due to the toxicity of Hg, however, other factors may influence this.

d) $Bi_{100-x}Sn_x$: where x=5 to 42. These alloys have melting points ranging from 138 to $_{271}$° C. However, unless supercooled, the last-to-freeze phase will solidify at 138° C. (the eutectic temperature). This alloy is very attractive due to its melting point, since this temperature would be applicable for most well applications. Examples of commercial alloys include: Ostalloy 281, Indalloy 281 or Cerrotru 5800-2.

Lead (Pb) is often included according to $Bi_{100-x-y}Sn_xPb_y$ (where x+y<45—generally y<6). This results in an alloy with a lower melting point than binary Bi—Sn. Examples of commercial alloys include: Cerrobase 5684-2, or 5742-3; Ostalloy 250277, or 262271.

Additional alloying additions can be made, which produce a multiphased, but very low melting point alloy, such as "Wood's Metal" (typically: $Bi_{50}Pb_{25}Sn_{12.5}Cd_{12.5}$); there is a wide variety of these metals. However, the majority of these alloys have melting points too low (e.g. Dalton Metal: $Bi_{60}Pb_{25}Sn_{15}$ has a melting point of 92° C., Indalloy 117 has a melting point of 47° C.) to be of interest in well applications, with the exception noted above regarding cool liquid placement.

e) $Bi_{100-x}Pb_x$: where x=0 to 44.5. These alloys could be used for lower melting points desired, since the eutectic temperature is at 124° C. Additions of Indium (In), Cadmium (Cd) or Tin (Sn) are common, and all further reduce the melting point. The binary eutectic is sold by Cerro Metal Products as "Cerrobase".

f) Others: $Bi_{100-x}Xn_x$: where x=0 to 4.5. (Eutectic point at x=4.5.) These alloys are considered for higher temperature applications since their melting points range from 257 to 271° C. $Bi_{100-x}Cd_x$: where x=0 to 40. (Eutectic point at x=4.5.) Melting point of eutectic 144° C. $Bi_{100-x}In_x$: with x<33. Often includes other elements to have very low (<100° C.) melting points (for example Indalloy 25).

Thus, it will be apparent to those skilled in the art that a variety of Bismuth, Gallium and other expandable alloys are suitable for in-situ casting of seals and/or other components for use in well construction, workover, treatment and abandonment operations.

EXAMPLES

1) An experiment was carried out to verify that the expansion behaviour of Bismuth alloys is not limited to atmospheric conditions. A $Bi_{58}Sn_{42}$ (Bismuth-Tin) alloy was solidified in a pressurized chamber at 400 bar pressure. The pressurized chamber formed part of an experimental device which is described in SPE paper 64762 ("Improved Experimental Characterization of Cement/Rubber Zonal Isolation Materials", authors M G Bosma, E K Cornelissen and A Schwing). The experiment indicated that under the test conditions the alloy expanded by 1.41% by volume.

2) Another sample of a $Bi_{58}Sn_{42}$ alloy was cast into a dirty (i.e. coated with API Pipe Dope) piece of a tubular with an internal diameter of 37.5 cm and subsequently allowed to be solidified into a plug having a length of 104.6 mm within the tubular to test the sealing ability of the alloy. Water pressure was applied to the tubular section at one end of the solidified plug and the differential pressure was measured across the plug. The water pressure was gradually increased and the plug was able to withstand a differential pressure of 80 bar before leaking commenced.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A method of in-situ casting well equipment wherein a metal is used which expands upon solidification, the method comprising the steps of:

placing a first body of said metal in a cavity in a well;

bringing said first body at a temperature above the melting point of the metal; and cooling down said first body to below the melting point of the metal, thereby solidifying the metal of said first body in the cavity, wherein the cavity is an annular cavity between a pair of co-axial well tubulars, the first body being axially restrained in the cavity by a second body of metal which expands upon solidification, and wherein the metal of the second body solidifies at a higher temperature than the metal of the first body, the method further comprising:

placing the second body in the annular cavity axially displaced from the first body;

melting said bodies by raising the temperature of said bodies; and solidifying said bodies by lowering the temperature of said bodies, whereby the metal of the second body solidifies before the metal of the first body thereby axially restraining the first body.

2. The method of claim 1, wherein said metal is an alloy comprising Bismuth.

3. The method of claim 2, wherein said first body is lowered through the well in a container in which the temperature is maintained above the melting temperature of the metal and an outlet of the container is brought in fluid communication with the cavity whereupon the molten metal is induced to flow via said outlet into the cavity.

4. The method of claim 2, wherein said first body is placed in a solid state in or adjacent the cavity and heated downhole to a temperature above the melting temperature of the metal whereupon the heating is terminated and the metal is allowed to solidify and thereby to expand within the cavity.

5. The method of claim 2, wherein the cavity is an annular cavity between a pair of co-axial well tubulars.

6. The method of claim 1, wherein said first body is lowered through the well in a container in which the temperature is maintained above the melting temperature of the metal and an outlet of the container is brought in fluid communication with the cavity whereupon the molten metal is induced to flow via said outlet into the cavity.

7. The method of claim 6, wherein the cavity is an annular cavity between a pair of co-axial well tubulars.

8. The method of claim 7, wherein said metal is an alloy comprising Gallium.

9. The method of claim 7, wherein said metal is an alloy comprising Antimony.

10. The method of claim 6, wherein said metal is an alloy comprising Gallium.

11. The method of claim 6, wherein said metal is an alloy comprising Antimony.

12. The method of claim 1, wherein said first body is placed in a solid state in or adjacent the cavity and heated downhole to a temperature above the melting temperature of the metal whereupon the heating is terminated and the metal is allowed to solidify and thereby to expand within the cavity.

13. The method of claim 12, wherein the cavity is an annular cavity between a pair of co-axial well tubulars.

14. The method of claim 13, wherein said metal is an alloy comprising Gallium.

15. The method of claim 13, wherein said metal is an alloy comprising Antimony.

16. The method of claim 12, wherein said metal is an alloy comprising Gallium.

17. The method of claim 12, wherein said metal is an alloy comprising Antimony.

18. The method of claim 1, wherein the annular cavity is formed by an annular space between overlapping sections of an outer well tubular and an expanded inner well tubular.

19. The method of claim 18, wherein the cavity has near a lower end a bottom or flow restriction that inhibits leakage of molten metal from the cavity into other parts of the well.

20. The method of claim 1, wherein the cavity has near a lower end a bottom or flow restriction that inhibits leakage of molten metal from the cavity into other parts of the well.

21. The method of claim 20, wherein the flow restriction is formed by a flexible sealing ring which is located near a lower end of the annular space.

22. The method of claim 21, wherein the flexible sealing ring comprises an array of staggered non-tangential slots or openings which open up in response to radial expansion of the tubular.

23. The method of claim 1, wherein said metal is an alloy comprising Gallium.

24. The method of claim 1, wherein said metal is an alloy comprising Antimony.

25. A method of in-situ casting well equipment wherein a metal is used which expands upon solidification, the method comprising the steps of:

placing a body of said metal in a cavity in a well;

bringing said body at a temperature above the melting point of the metal; and cooling down said body to below the melting point of the metal, thereby solidifying the metal of said body in the cavity, wherein the cavity is an annular cavity formed by an annular space between overlapping sections of an outer well tubular and an expanded inner well tubular.

26. The method of claim 25, wherein the cavity has near a lower end a bottom or flow restriction that inhibits leakage of molten metal from the cavity into other parts of the well.

27. The method of claim 26, wherein the flow restriction is formed by a flexible sealing ring which is located near a lower end of the annular space.

28. The method of claim 27, wherein the flexible sealing ring comprises an array of staggered non-tangential slots or openings which open up in response to radial expansion of the tubular.

29. The method of claim 25, wherein placing the body of said metal in the cavity comprises positioning a ring of the metal above the expanded inner well tubular and around an outer surface thereof.

30. The method of claim 29, wherein the ring comprises an array of staggered non-tangential slots or openings.

31. The method of claim 29, wherein the ring comprises a split ring with overlapping ends.

32. The method of claim 25, wherein the expanded inner well tubular is a pre-expanded inner well tubular, and wherein after placing the body of said metal in the cavity the pre-expanded inner well tubular is expanded.

33. The method of claim 32, wherein after expanding the pre-expanded inner well tubular heat is applied from the inside of the inner well tubular to increase the temperature of the metal.

34. The method of claim 25, wherein said metal is an alloy comprising Bismuth.

35. The method of claim 25, wherein said metal is an alloy comprising Gallium.

36. The method of claim 25, wherein said metal is an alloy comprising Antimony.

* * * * *